US009208714B2

(12) United States Patent
Yamashita

(10) Patent No.: US 9,208,714 B2
(45) Date of Patent: Dec. 8, 2015

(54) DISPLAY PANEL FOR REFRESHING IMAGE DATA AND OPERATING METHOD THEREOF

(75) Inventor: Keitaro Yamashita, Hyogo (JP)

(73) Assignee: INNOLUX CORPORATION, Chu-Nan (TW)

( * ) Notice: Subject to any disclaimer, the term of this patent is extended or adjusted under 35 U.S.C. 154(b) by 1035 days.

(21) Appl. No.: 13/198,657

(22) Filed: Aug. 4, 2011

(65) Prior Publication Data

US 2013/0033509 A1 Feb. 7, 2013

(51) Int. Cl.
*G09G 3/20* (2006.01)

(52) U.S. Cl.
CPC ..... *G09G 3/2007* (2013.01); *G09G 2300/043* (2013.01); *G09G 2300/0838* (2013.01); *G09G 2300/0876* (2013.01); *G09G 2310/04* (2013.01)

(58) Field of Classification Search
CPC ..... G09G 3/20; G09G 3/3618; G09G 3/3611
See application file for complete search history.

(56) References Cited

U.S. PATENT DOCUMENTS

| | | | | |
|---|---|---|---|---|
| 6,310,618 | B1 * | 10/2001 | Zhang et al. | 345/213 |
| 6,452,592 | B2 * | 9/2002 | Zhang et al. | 345/213 |
| 7,283,111 | B2 * | 10/2007 | Kimura | 345/77 |
| 7,586,473 | B2 * | 9/2009 | Edwards et al. | 345/92 |
| 8,031,141 | B2 * | 10/2011 | Shin | 345/76 |
| 8,077,126 | B2 * | 12/2011 | Lee et al. | 345/77 |
| 8,194,018 | B2 * | 6/2012 | Nagata | 345/87 |
| 8,717,273 | B2 * | 5/2014 | Hachida et al. | 345/98 |
| 8,803,768 | B2 * | 8/2014 | Kimura et al. | 345/76 |
| 2003/0016202 | A1 * | 1/2003 | Edwards et al. | 345/98 |
| 2006/0181495 | A1 * | 8/2006 | Edward | 345/92 |
| 2007/0040785 | A1 * | 2/2007 | Edwards et al. | 345/92 |
| 2009/0002582 | A1 * | 1/2009 | Sano | 349/38 |
| 2009/0040174 | A1 | 2/2009 | Yamashita | |
| 2009/0128473 | A1 | 5/2009 | Yamashita et al. | |

(Continued)

FOREIGN PATENT DOCUMENTS

| | | |
|---|---|---|
| WO | 03/007286 | 1/2003 |
| WO | 03/009268 | 1/2003 |
| WO | 2004/090854 | 10/2004 |

OTHER PUBLICATIONS

Yamashita et al., 33.5: Late News Paper: "Dynamic Self-Refreshing Memory-in-Pixel Circuit for Low Power Standby Mode in Mobile LTPS TFT-LCD", SID 04 Digest, pp. 1-4.

(Continued)

*Primary Examiner* — Kumar Patel
*Assistant Examiner* — Sejoon Ahn
(74) *Attorney, Agent, or Firm* — Liu & Liu

(57) ABSTRACT

A display panel is provided, including an image data storage capacitor, a capacitive element, and four switches. The image data storage capacitor stores an image data. The sample unit has a control terminal for receiving a sample control signal. The capacitive element has a first terminal coupled to a pixel electrode of the image data storage capacitor via the sample unit. The first refresh unit has a control terminal coupled to the first terminal. The second refresh unit has a control terminal for receiving a refresh control signal. The third and first refresh units are serially coupled with each other between a corresponding source line and the image data storage capacitor for receiving a data signal. The shunt unit has a control terminal coupled to the pixel electrode, a data terminal coupled to the first terminal, and another data terminal for receiving a shunt control signal.

13 Claims, 11 Drawing Sheets

(56) References Cited

U.S. PATENT DOCUMENTS

| | | | | |
|---|---|---|---|---|
| 2009/0184950 | A1* | 7/2009 | Furuta et al. | 345/211 |
| 2009/0284500 | A1 | 11/2009 | Yamashita | |
| 2009/0303168 | A1* | 12/2009 | Nagata | 345/90 |
| 2010/0001970 | A1 | 1/2010 | Yamashita | |
| 2010/0085286 | A1 | 4/2010 | Yamashita et al. | |
| 2010/0177083 | A1* | 7/2010 | Yamashita | 345/211 |
| 2010/0231814 | A1* | 9/2010 | Yamada et al. | 348/792 |
| 2010/0277461 | A1* | 11/2010 | Ruckmongathan | 345/213 |
| 2011/0109612 | A1* | 5/2011 | Chaji et al. | 345/211 |
| 2012/0169753 | A1* | 7/2012 | Murakami et al. | 345/560 |
| 2012/0242640 | A1* | 9/2012 | Hong et al. | 345/211 |

OTHER PUBLICATIONS

Ueda et al, 43.1: "A Novel Multi-level Memory in Pixel Technology for Ultra Low Power LTPS TFT-LCD", SID 10 Digest, pp. 615-618.

* cited by examiner

DISPLAY PANEL FOR REFRESHING IMAGE DATA AND OPERATING METHOD THEREOF

BACKGROUND OF THE INVENTION

1. Field of the Invention

The invention relates in general to a display panel and an operating method thereof, and more particularly to an active matrix display panel and an operating method thereof.

2. Description of the Related Art

Display devices have been widespread used in a variety of applications, such as lap-top computers, mobile phones, or personal digital assistants. In such devices, bit numbers employed to express the respective pixels of an image, determine the color depth of the image. In general, the visual quality of the image increases with the bit numbers.

However, most of conventional memory in pixel (MIP) circuits usually use a memory which is for storing one bit data. This means that the color depth or grayscale reproducibility is intrinsically limited in two levels, black or white. Although intermediate gray-levels can be generated by pixel rendering, or dithering, in which a number of adjacent pixels can be grouped as a new pixel for displaying, the resolution will be reduced.

SUMMARY OF THE INVENTION

The invention is directed to a display panel and an operating method thereof, in which a pixel element is implemented as a multi-bit memory for being operated to increase the number of gray-levels of the active matrix pixel array.

According to an aspect of the present invention, a display panel is provided. The display panel includes a data driver, a source driver, and an active matrix pixel array includes a number of gate lines, a number of source lines, and a number of pixel elements arranged in a matrix. The source driver is for driving the source lines. The gate driver is for driving the gate lines. Each pixel element is coupled to the corresponding gate line and the corresponding source line. Each pixel element includes an image data storage capacitor and a gate switch. The image data storage capacitor stores an image data. The gate switch has a control terminal coupled to the corresponding gate line. The gate switch is coupled between the corresponding source line and the image data storage capacitor. Each pixel element further includes a first to shunt units and a capacitive element. The sample unit has a control terminal for receiving a sample control signal. The capacitive element has a first terminal coupled to a pixel electrode of the image data storage capacitor via the sample unit. The first refresh unit has a control terminal coupled to the first terminal of the capacitive element. The second refresh unit has a control terminal for receiving a refresh control signal. The second refresh unit and the first refresh unit are serially coupled with each other. The first refresh unit and second refresh unit are coupled between the corresponding source line and the image data storage capacitor for receiving a data signal. The shunt unit has a control terminal coupled to the pixel electrode, a data terminal coupled to the first terminal, and another data terminal for receiving a shunt control signal.

According to another aspect of the present invention, a control method is provided. The control method includes a number of steps. An image data is stored in an image data storage capacitor. The image data of the image data storage capacitor is stored in a capacitive element through a sample unit. In a first period, a shunt control signal having a first shunt voltage is provided to selectively control the voltage of the first terminal of the capacitive element through a shunt unit, and a data signal having a first data voltage is provided to selectively refresh the image data of the image data storage capacitor through a first refresh unit and a second refresh unit. The first refresh unit is controlled by the voltage of the first terminal of the capacitive element. The shunt unit is controlled by the voltage of the pixel electrode of the image data storage capacitor. In a second period, the shunt control signal having a second shunt voltage is provided to selectively control the voltage of the first terminal of the capacitive element through the shunt unit, and the data signal having a second data voltage is provided to selectively refresh the image data of the image data storage capacitor through the first refresh unit and the second refresh unit. When the image data is of a first image data, the image data of the image data storage capacitor are refreshed during the first period, and when the image data is of a second image data, the image data of the image data storage capacitor are refreshed during the second period.

According to another aspect of the present invention, a display panel. The display panel includes a number of gate lines, a number of source lines, and a number of pixel elements. The pixel elements are arranged in a matrix, each pixel element being coupled to the corresponding gate line and the corresponding source line. Each pixel element includes an image data storage capacitor for storing an image data; a sample unit controlled by a sample control signal; a capacitive element having a first terminal coupled to a pixel electrode of the image data storage capacitor via the sample unit; a first refresh unit controlled by the voltage on the first terminal; a second refresh unit controlled by a refresh control signal, the first and second refresh units transmitting a data signal from the corresponding source line to the image data storage capacitor when both of the first and second refresh units are enabled; and a shunt unit controlled by the voltage on the pixel electrode, the shunt unit having a data terminal coupled to the first terminal, and another data terminal for receiving a shunt control signal.

The above and other aspects of the invention will become better understood with regard to the following detailed description of the preferred but non-limiting embodiment(s). The following description is made with reference to the accompanying drawings.

DETAILED DESCRIPTION OF THE INVENTION

A display panel, a pixel element, and an operating method thereof are provided in a number of embodiments of the invention as follows. The display panel is adapted of being operated at two modes, one of which is, for example, an active mode such as the video mode of a display device, while the other is, for example, a passive or refresh mode such as a standby mode of an electronic device including the active matrix display device. When being operated at the active mode, the active matrix display device writes image data in the pixel element. When being operated at the refresh mode, the active matrix display device allows the pixel element to refresh its stored image data, i.e., to maintain the image data of the pixel element, thus generating a constant output such as static image over a prolonged period of time.

In an embodiment, the display panel including a number of image data storage capacitors. The control method includes a number of steps as follows. An image data is stored in an image data storage capacitor. The image data of the image data storage capacitor is stored in a capacitive element through a sample unit. In a first period, a shunt control signal having a first shunt voltage is provided to selectively control the voltage of the first terminal of the capacitive element through a shunt unit, and a data signal having a first data voltage is provided to selectively refresh the image data of the image data storage capacitor through a first refresh unit and a second refresh unit. The first refresh unit is controlled by the voltage of the first terminal of the capacitive element. The shunt unit is controlled by the voltage of the pixel electrode of the image data storage capacitor. In a second period, the shunt control signal having a second shunt voltage is provided to selectively control the voltage of the first terminal of the capacitive element through the shunt unit, and the data signal having a second data voltage is provided to selectively refresh the image data of the image data storage capacitor through the first refresh unit and the second refresh unit. When the image data is of a first image data, the image data of the image data storage capacitor are refreshed during the first period, and when the image data is of a second image data, the image data of the image data storage capacitor are refreshed during the second period. In this way, the image data storage capacitor can be used to stored different image data and refreshed by a corresponding data voltage of the data signal, enabling the display panel to reveal an increased number of gray-levels for displaying.

Figure 1:
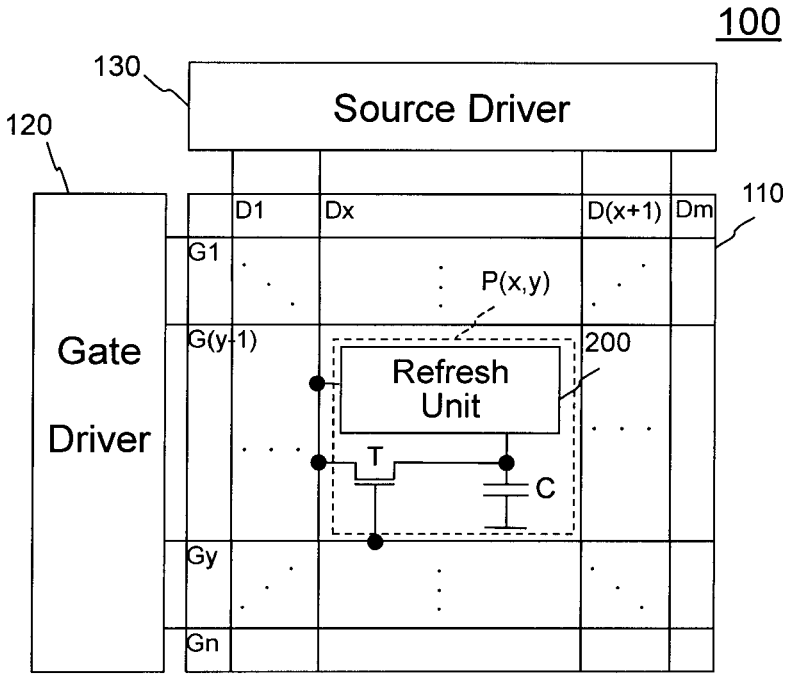
FIG. 1 is a block diagram showing an example of a display panel.

FIG. 1 is a block diagram showing an example of a display panel. The display panel 100 at least includes an active matrix pixel array 110, a gate driver 120, and a source driver 130. The active matrix pixel array 110 includes a number of gate lines G1-Gn and a number of source lines D1-Dm. The gate driver 120 drives the scan lines G1-Gn. The source driver 130 drives the source lines D1-Dm. The active matrix pixel array 110 further includes a number of pixel elements arranged in a matrix and each being coupled to the corresponding gate line and the corresponding source line. As is made as an example, a pixel element P(x,y) includes an image data storage capacitor C, a gate switch T, and a refresh unit 200 according to an embodiment of the invention. The gate switch T has a control terminal coupled to the corresponding gate line Gy, and is coupled between the corresponding source line Dx and the image data storage capacitor C. The refresh unit 200 is coupled between the corresponding source line Dx and the image data storage capacitor C.

Figure 2:
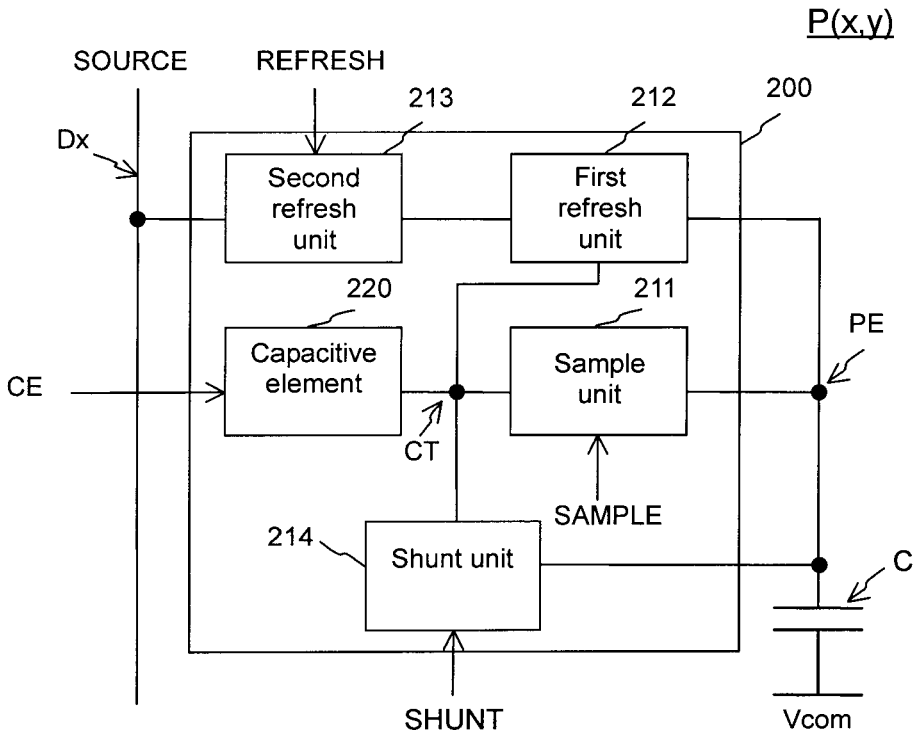
FIG. 2 is a block diagram showing a pixel element of the display panel in FIG. 1 according to an embodiment of the invention.

FIG. 2 is a block diagram showing a pixel element of the display panel 100 in FIG. 1 according to an embodiment of the invention. In this example of the pixel element P(x,y), the refresh unit 200 includes a sample unit 211, a first refresh unit 212, a second refresh unit 213, a shunt unit 214, and a capacitive element 220. Each unit includes for example one or more than one switches. The sample unit 211 has a control terminal for receiving a sample control signal SAMPLE. The first refresh unit 212 has a control terminal coupled to a first terminal (denoted as a node of CT) of the capacitive element 220. The second refresh unit 213 has a control terminal for receiving a refresh control signal REFRESH. The second refresh unit 213 and the first refresh unit 212 are serially coupled with each other. The first refresh unit 212 has a terminal coupled to a pixel electrode (denoted as a node of PE) of the image data storage capacitor C, and the second refresh unit 213 has a terminal for receiving a data signal SOURCE. The capacitive element 220 has the first terminal CT coupled to the pixel electrode PE of the image data storage capacitor C via the sample unit 211. The capacitive element 220 further has a second terminal for receiving an enable signal CE. The shunt unit 214 has a control terminal coupled to the pixel electrode PE, a terminal coupled to the first terminal CT of the capacitive element 220, and another terminal for receiving a shunt control signal SHUNT.

In an embodiment, the refresh unit 200 performs a sample operation and a number of refresh operations. In the sample operation, the capacitive element 220 is used for storing the image data of the image data storage capacitor C. The capacitive element 220 preferably can be implemented as having a smaller capacitance than that of the image data storage capacitor C, preventing the image data stored in the image data storage capacitor C from being significantly affected in the sample operation. The capacitive element 220 is regarded as a memory for storing the data of the image data storage capacitor C. The voltage of the first terminal CT on the capacitive element 220 is used to control the first refresh unit 212, so as to determine whether or not a refresh voltage such as the data signal SOURCE is used to refresh the image data storage capacitor C in a refresh operation. This renders the pixel element P(x,y) to become a self-refreshing memory in pixel (MIP). With the MIP, the active matrix pixel array can be operated similarly based on a DRAM concept and suitable for high resolution display such as high end smart phone or e-reader applications.

In these refresh operations, each of the shunt control signal SHUNT and the data signal SOURCE sequentially has a number of voltages, and the voltages are in a monotonic order. In an exemplary embodiment, there can be four refresh operations performed to refresh 2-bit image data. To put it simply, the image data of the image data storage capacitor C can be one of four binary values “11”, “10”, “01”, “00”, and can be refreshed in a corresponding one of the four refresh operations which are sequentially performed to provide the data signal SOURCE with one of four voltage levels. As such, the pixel element P(x,y) of the active matrix pixel array 110 can be used to store one of different image data and refreshed in one of the refresh operations, thus becoming a multi-bit MIP circuit with which the numbers of gray-levels can be increased.

Based on at least above, the refresh unit 200 refreshes the image data stored in the image data storage capacitor C in one of the refresh operations. Exemplary configurations and the further description are described as follows.

Figure 3A:
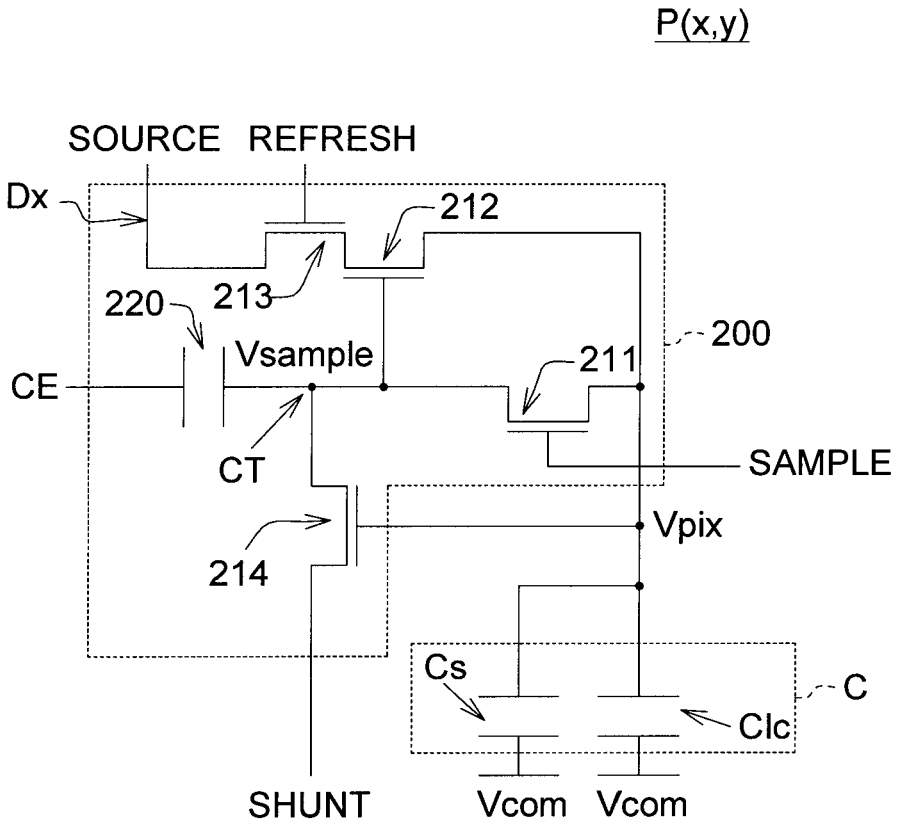
FIG. 3A is a circuit diagram showing an example of the pixel element in FIG. 2 according to an embodiment of the invention.

FIG. 3A is a circuit diagram showing an example of the pixel element in FIG. 2 according to an embodiment of the invention. In this example, these units 211-214 of the pixel element P(x,y) are exemplified as being implemented by N-type transistors, such as n-type thin film transistors. The first refresh unit 212 is coupled between the second refresh unit 213 and the image data storage capacitor C. The image data storage capacitor C is exemplarily represented by a combination of two capacitors such as a liquid crystal capacitor Clc and a storage capacitor Cs.

Figure 3B:
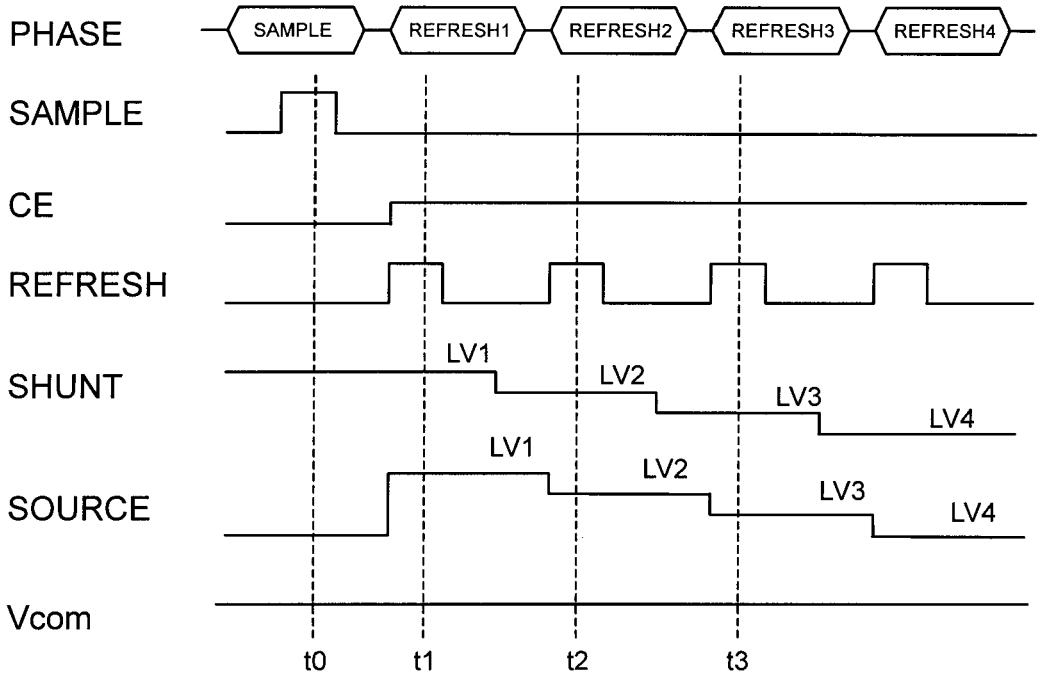
FIG. 3B is a timing diagram showing a number of signal waveforms that the display panel uses to execute a control method according to an embodiment of the invention.

The operation of the pixel element in FIG. 3A, thus, is provided with reference to FIG. 3B as follows. FIG. 3B is a timing diagram showing a number of signal waveforms that the display panel uses to execute an operating method according to an embodiment of the invention.

As is shown in FIG. 3B, the display panel 100 is operated to perform a sample operation, and four refresh operations, for example. In these refresh operations, each of the data signal SOURCE and the shunt control signal SHUNT has a first voltage LV1 during a first period of a first refresh operation, a second voltage LV2 during a second period of a second refresh operation, a third voltage LV3 during a third period of a third refresh operation, and a fourth voltage LV4 during a fourth period of a fourth refresh operation. The first to fourth voltages LV1-LV4 are in a monotonic order, such as a decreasing order of 6V, 4V, 2V, and 0V. In other words, the pixel element P(x,y) in FIG. 3A is exemplarily implemented as a 2-bit MIP circuit, capable of generating at least four different gray-levels from image data which is one of four binary values "11", "10", "01", and "00", which correspond to pixel voltages Vpix of 6V, 4V, 2V and 0V when Vcom is at 0V.

As is shown in FIG. 3B, the data signal SOURCE and the shunt control signal SHUNT are exemplarily provided as having substantially the same voltages LV1-LV4. However, this invention is not limited thereto. In another embodiment, voltage levels of the data signal SOURCE and the shunt control signal SHUNT can be different, as being referenced to a number of data voltages of the data signal SOURCE and a number of shunt voltages of shunt control signal SHUNT. The voltages of the data signal SOURCE and the shunt control signal SHUNT can be based on a situation where when the image data is of a value, it is refreshed during a period of a refresh operation instead of during another period of another refresh operation for the image data of another value.

The following description is made as an example that the refreshed image data has the same polarity as the polarity of the image data stored in the image data storage capacitor C in the sample operation. In the example, the sample control signal SAMPLE is first enabled, and the refresh control signal REFRESH is repeatedly enabled four times. The to-be-refreshed image data can be of one of four binary values "11", "10", "01", and "00", which are respectively illustrated below.

The image data of "11" is refreshed while its polarity remained, e.g., "Vpix, Vcom"="6V, 0V" to "6V, 0V".

First, it is assumed that the pixel voltage Vpix is initially 6V and the common voltage Vcom is initially 0V, indicating that the image data stored in the image data storage capacitor C is "11", i.e., the voltage across the image data storage capacitor C is 6V. Refer to a time t0 where a sample operation is performed. The sample control signal SAMPLE is enabled at a high level to turn on the sample unit 211. Via the turn-on sample unit 211, the first terminal CT of capacitive element 220 is biased at substantially the same level of the current pixel voltage Vpix. This means that the pixel voltage Vpix is sampled as a sample voltage Vsample and stored in the capacitive element 220, i.e., Vsample=6V. The enable signal CE is disabled at a first level of, for example, 0V.

Then, refer to a time t1 where a first refresh operation is performed. The data signal SOURCE has a first voltage LV1 of, for example, 6V at time t1. The enable signal CE is transited from the first level to a second level of, for example, from 0V to 1.5V. The different between the first level and the second level of the enabled signal CE is, in this example, 1.5V, higher than the threshold voltage of the first refresh unit 212, so as to compensate for the threshold voltage of the first refresh unit 212. The enable signal CE pushes up the sample voltage Vsample to about 7.5V (=6V+1.5V) via the capacitive element 220. Between the sample voltage Vsample and the pixel voltage Vpix, there is a voltage difference of 1.5 V (Vsample−Vpix=7.5V−6V) higher than the threshold voltage of 1V of the first refresh unit 212, so that the first refresh unit 212 is turned on. Also, the refresh control signal REFRESH is enabled to turn on the second refresh unit 213. Via the turn-on second and second refresh units 212 and 213, the first voltage LV1 (=6V) of the data signal SOURCE is provided to refresh the pixel voltage Vpix of 6V which may have decayed due to TFT leakage current. Meanwhile, the common voltage Vcom is remained at a low level of, for example, 0V. Thus, when the first refresh operation is performed, the refreshed image data at time t1 ("Vpix, Vcom"="6V, 0V") has the same polarity as the polarity of the image data at time t0 ("Vpix, Vcom"="6V, 0V").

Next, refer to a time t2 where a second refresh operation is performed. The data signal SOURCE has a second voltage LV2 of, for example, 4V at time t2. Similarly, the shunt control signal SHUNT has the second voltage of 4V. The second voltage LV2 is used to refresh another image data of 4V stored in another image data storage capacitor in the second refresh operation. Between the pixel voltage Vpix and the second voltage LV2 of the shunt control signal SHUNT, there is a voltage difference of 2V (Vpix−LV2=6V−4V) higher than the threshold voltage of 1V of the shunt unit 214, so that the shunt unit 214 is turned on. Via the turn-on shunt unit 214, the first terminal CT of the capacitive element 220 is biased at the second voltage LV2 of the shunt control signal SHUNT, i.e., Vsample=4V. At this time, the first refresh unit 212 is turned off since the voltage difference therebetween is −2V (Vsample−Vpix=4V−6V), lower than its threshold voltage of 1V. In this way, the second voltage LV2 (=4V) of the data signal SOURCE will not be used to refresh the pixel voltage Vpix of 6V, neither the third voltage LV3 (=2V) and the fourth voltage LV4 (=0V) of the data signal SOURCE.

The image data of "10" is refreshed while its polarity remained, e.g., "Vpix, Vcom"="4V, 0V" to "4V, 0V".

Similar operation can be referred to previous description for the image data of 6V, and is abbreviated for the sake of brevity. First, it is assumed that the pixel voltage Vpix is initially 4V and the common voltage Vcom is initially 0V, indicating that the image data stored in the image data storage capacitor C is 4V. Then, refer to the time t0, the sample voltage Vsample is about 4V.

Then, refer to the time t1 in the first refresh operation, the enable signal CE pushes up the sample voltage Vsample to about 5.5V (=4V+1.5V) via the capacitive element 220. Between the sample voltage Vsample and the pixel voltage Vpix, there is a voltage difference of 1.5V (Vsample−Vpix=5.5V−4V) higher than the threshold voltage of 1V of the first refresh unit 212, so that the first refresh unit 212 is turned on. Also, the refresh control signal REFRESH is enabled to turn on the second refresh unit 213. Via the turn-on second and second refresh unites 212 and 213, the pixel voltage Vpix of 4V is slightly affected by the first voltage LV1 (=6V) of the data signal SOURCE and increased to, for example, 4.5V, where the voltage increment of the pixel voltage Vpix is under control of its threshold voltage of 1V, i.e., Vsample−Vpix=5.5−4.5.

Next, refer to the time t2 in the second refresh operation. The data signal SOURCE has the second voltage LV2 of, for example, 4V. Between the sample voltage Vsample and the second voltage LV2 of the data signal SOURCE, there is a voltage difference of 1.5 V (Vsample−LV2=5.5V−4V) higher than the threshold voltage of 1V of the first refresh unit 212, so that the first refresh unit 212 is turned on. Also, the refresh control signal REFRESH is enabled again to turn on the second refresh unit 213. Via the turn-on second and second refresh unites 212 and 213, the second voltage LV2 (=4V) of the data signal SOURCE is provided to refresh the pixel voltage Vpix of 4V, thus pushing down the pixel voltage Vpix from 4.5V to 4V as is required. Thus, when the first refresh operation is performed, the refreshed image data at time t2 ("Vpix, Vcom"="4V, 0V") has the same polarity as the polarity of the image data at time t1 ("Vpix, Vcom"="4V, 0V").

After that, refer to a time t3 where a third refresh operation is performed. The data signal SOURCE has a third voltage LV3 of, for example, 2V at time t3. Similarly, the shunt control signal SHUNT has the third voltage LV3 of 2V. Between the pixel voltage Vpix and the third voltage LV3 of the shunt control signal SHUNT, there is a voltage difference of 2V (Vpix−LV3=4V−2V) higher than the threshold voltage of 1V of the shunt unit 214, so that the shunt unit 214 is turned on. Via the turn-on shunt unit 214, the sample voltage Vsample of the capacitive element 220 is biased at the third voltage LV3 of the shunt control signal SHUNT, i.e., Vsample=2V. At this time, the first refresh unit 212 is turned off since the voltage difference therebetween is −2V (Vsample−Vpix=2V−4V), lower than its threshold voltage of 1V. In this way, the third voltage LV3 (=2V) of the data signal SOURCE will not be used to refresh the pixel voltage Vpix of 4V, neither the fourth voltage LV4 (=0V) of the data signal SOURCE.

As to the image data of "01" ("Vpix, Vcom"="2V, 0V" to "2V, 0V") and "00" ("Vpix, Vcom"="0V, 0V" to "0V, 0V"), their operation, thus, can be described similarly with reference to the above-related description of the refresh operations for the image data storage capacitor C of "11" and "10", and will not be specified for the sake of brevity.

In a practical example, the transition from the first voltage LV1 to the second voltage LV2 in the shunt control signal SHUNT is in advance of the transition from the first voltage LV1 to the second voltage LV2 in the data signal SOURCE. This assures that there is enough time to control the stored image data in the capacitive element 220, such as to turn on the shunt unit 214 and change the voltage on its first terminal CT before the data signal SOURCE is changed as having a next voltage. In this way, the refreshed image data storage capacitor C can also be prevented from being modified by the next voltage of the data signal SOURCE. However, this invention is not limited thereto. No matter which one of the signals changes or transits from one voltage to another voltage earlier, in case that the second refresh unit 213 should be turned off during the voltage transition of these signals, their timing order will not affect the voltage of the capacitor 220. In other words, in another embodiment, the time that the shunt control signal SHUNT and the data signal SOURCE transited from one voltage to another is a time when the second refresh unit 213 is turned off. From another aspect, such time can also be regarded as a time the refresh control signal REFRESH is disabled, or a time between two adjacent enabled pulses of the refresh control signal REFRESH.

Figure 4A:
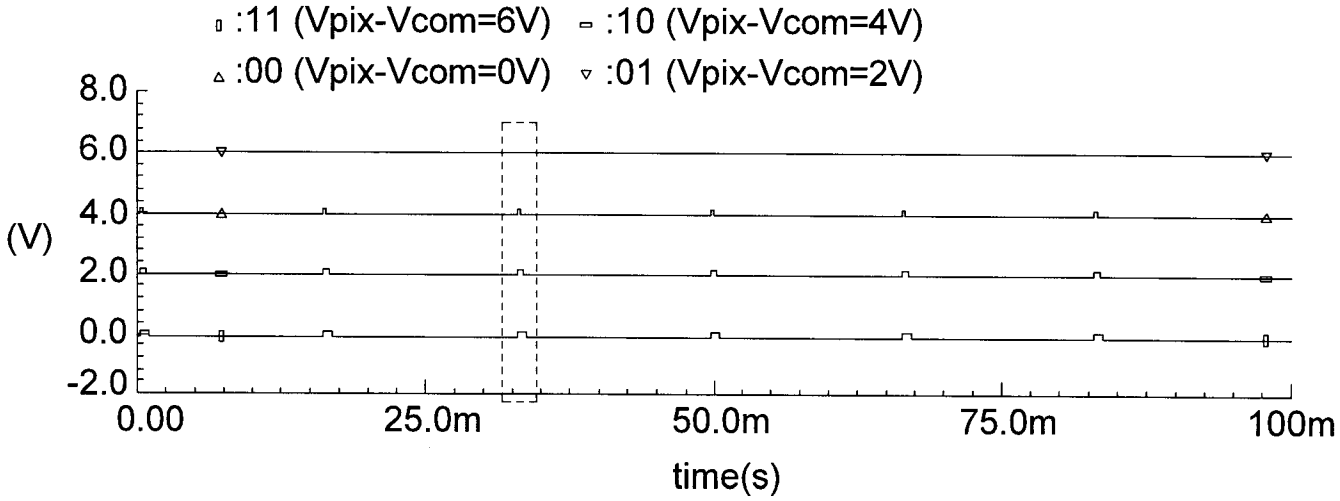
FIG. 4A is a timing diagram showing a number of simulated waveforms when four kinds of image data are refreshed according to the signal waveforms in FIG. 3B.
Figure 4B:
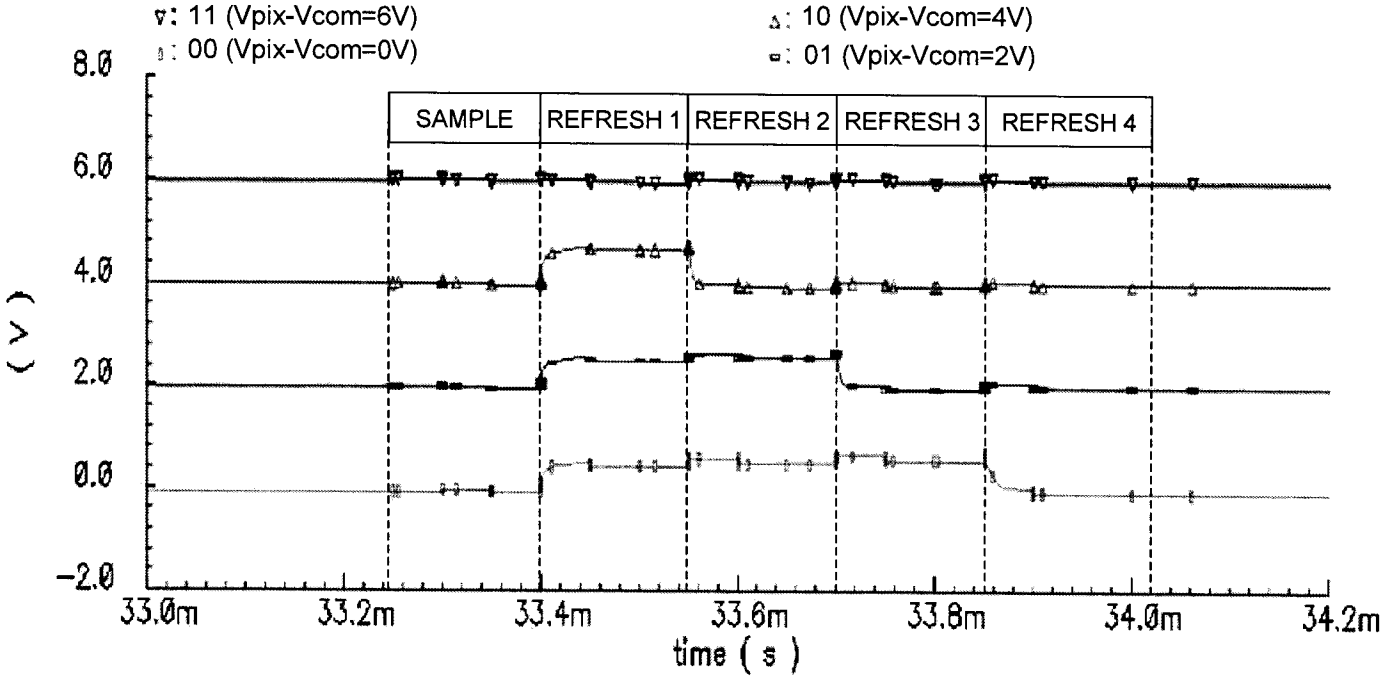
FIG. 4B is a timing diagram showing a number of simulated waveforms taken from a region in FIG. 4A denoted by dashed line.

FIG. 4A is a timing diagram showing a number of simulated waveforms when four kinds of image data are refreshed according to the signal waveforms in FIG. 3B. FIG. 4B is a timing diagram showing a number of simulated waveforms taken from a region in FIG. 4A denoted by dashed line. As is shown in FIGS. 4A and 4B, for an image data of "11" (Vpix−Vcom=6V) in the image data storage capacitor, it can be refreshed as having the same polarity. For an image data of "10" (Vpix−Vcom=4V), it is slightly increased during the first refresh operation, and pushed down to 4V during its second refresh operation. For an image data of "01" or "00" (Vpix−Vcom=2V or 0V), they can be refreshed in a similar manner. Therefore, in response to these signals in FIG. 3B, the pixel element P(x,y) in FIG. 3A can generate at least four corresponding gray-levels of 6V, 4V, 2V, and 0V, and become a 2-bit MIP circuit.

The group of signals in FIG. 3B is provided as an example to explain the operation of the 2-bit MIP circuit. However, this invention is not limited thereto. For example, as to forming a 3-bit MIP circuit, the display panel 100 can be operated to perform a sample operation, and eight refresh operations. In each one of these refresh operations, each of the data signal SOURCE and the shunt control signal SHUNT can be one of eight voltages. A person having ordinary skill in the art can acknowledge from the description of this invention that more voltages and refresh operations can be used, thus increasing the bit number of displayed data, and achieving a multi-bit MIP circuit.

Besides, as to the data signal SOURCE and the shunt control signal SHUNT shown in FIG. 3B, their first to fourth voltages LV1-LV4 are arranged in a decreasing order for illustration. In another example of the pixel element in FIG. 3A where at least some of the switches of the pixel element P(x,y) are implemented by P-type thin film transistors, the first to fourth voltages LV1-LV4 can also be arranged in an increasing order.

Figure 5A:
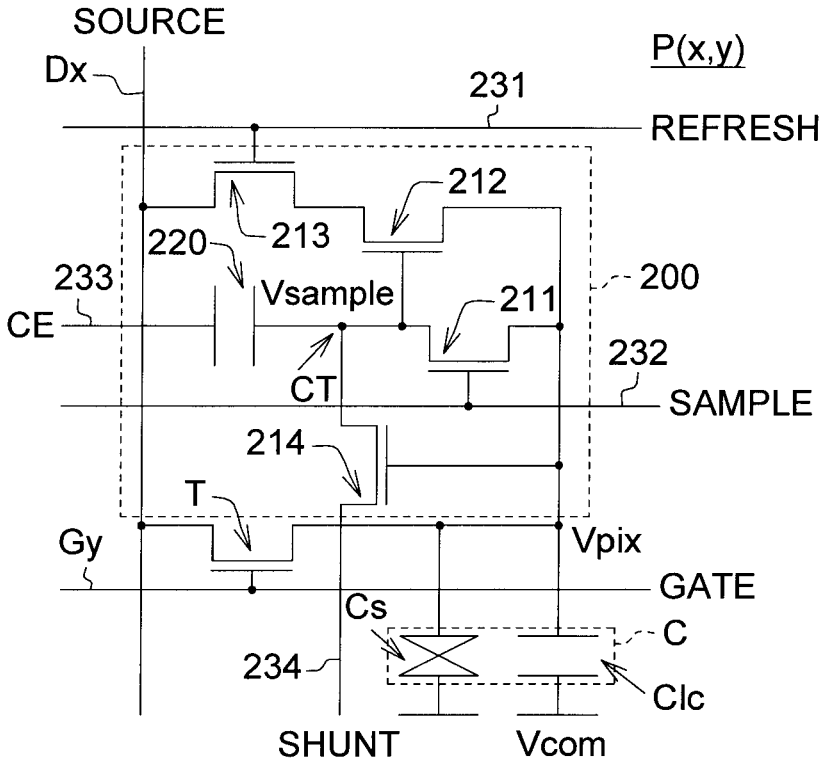
FIG. 5A is a circuit diagram showing an example of the pixel element in FIG. 1 according to another embodiment of the invention.

FIG. 5A is a circuit diagram showing an example of the pixel element in FIG. 1 according to another embodiment of the invention. In this embodiment, the refresh unit 200 has its switch elements 211~214 implemented by N-type transistors, which facilitates the manufacture process since the gate switch T can also be implemented in a similar manner. In the pixel element P(x,y), the data signal SOURCE can be provided from the corresponding source line Dx; while the refresh control signal REFRESH, the sample control signal SAMPLE, the enable signal CE, and the shunt control signal SHUNT can be provided from additional signal lines 231-234, respectively. The pixel element P(x,y) in FIG. 5A can be regarded as being implemented by a circuit architecture of 5T1C, i.e., five switches and one capacitors.

With the circuit architecture shown in FIG. 5A, not only power consumption can be reduced but image sticking can be improved. More specifically, the pixel element P(x,y) in FIG.

5A can be operated to selectively perform one of two refresh schemes. When a first refresh scheme is performed, the image data storage capacitor can have its stored image data refreshed while the polarity of the image data remained, thus reducing power consumption. When a second refresh scheme is performed, the polarity of the image data of the image data storage capacitor is inversed, as a result of preventing image sticking. In an embodiment, a combined refresh scheme is implemented by selectively using the first and second refresh schemes aforementioned. The first refresh scheme can be referred to the exemplary description related to FIG. 3B. As regards the second refresh scheme, its description is provided as follows with reference to FIGS. 5B and 5C.

Figure 5B:
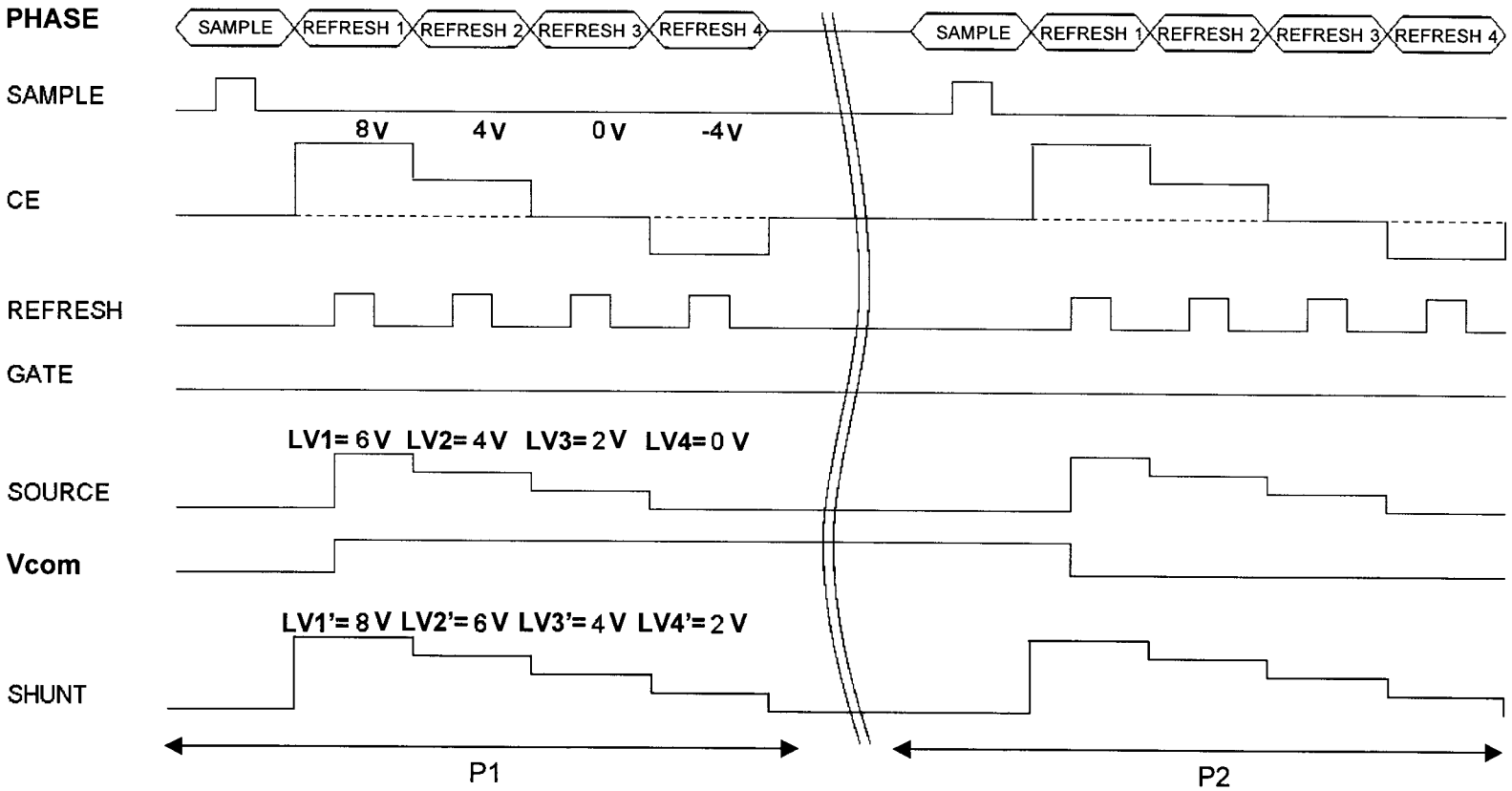
FIG. 5B is a timing diagram showing a number of signal waveforms that the display panel uses to execute an operating method according to another embodiment of the invention.

FIG. 5B is a timing diagram showing a number of signal waveforms that the display panel uses to execute an operating method according to another embodiment of the invention. In this embodiment, the common voltage Vcom is flipped. Flipping the common voltage Vcom means for example that the common voltage Vcom is converted from 0V to 6V in this case. In this example, voltage levels of the data signal SOURCE and the shunt control signal SHUNT are different from each other. For example, data voltages LV1-LV4 of the data signal SOURCE are respectively about 6V, 4V, 2V, 0V, while shunt voltages LV1'-LV4' of the shunt control signal SHUNT are respectively about 8V, 6V, 4V, 2V. According to the data voltages LV1-LV4 and shunt voltages LV1'-LV4', the enable signal CE has its voltage levels varied correspondingly, such as the levels of 8V, 4V, 0V, −4V.

Figure 5C:
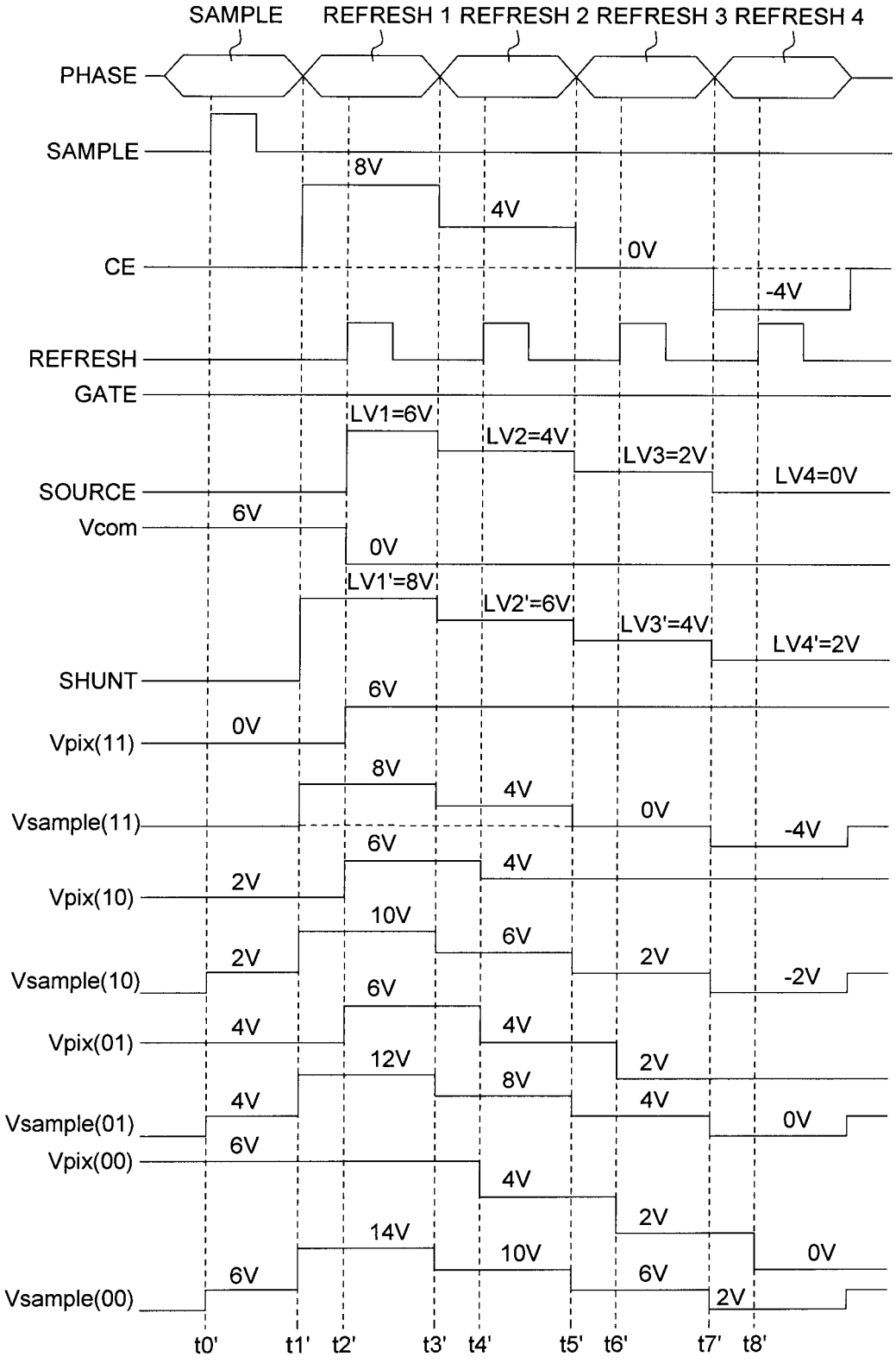
FIG. 5C is a timing diagram showing a portion of signal waveforms taken from FIG. 5B.

In response to the signals in FIG. 5B, the operation of the pixel element P(x,y) in FIG. 5A is exemplarily detailed as follows. In FIG. 5B, there are shown two periods P1 and P2. The operations of the pixel element P(x,y) during these two periods P1 and P2 are similarly to each other. For the sake of brevity, the operation of the pixel element P(x,y) during the period P2 is made as an example for illustration with reference to the accompanying drawing of FIG. 5C. FIG. 5C is a timing diagram showing a portion of signal waveforms taken from FIG. 5B. As can be seen from FIG. 5C, four kinds of image data of "00", "01", "10", and "11" can be properly refreshed, further description of which is as follows with reference to FIGS. 5A and 5C.

The image data of "11" is refreshed while its polarity inversed, e.g., "Vpix(11), Vcom"="0V, 6V" to "6V, 0V".

First, it is assumed that the pixel voltage Vpix(11) is initially 0V and the common voltage Vcom is initially 6V, indicating that the image data stored in the image data storage capacitor C is "11", i.e., the voltage across the image data storage capacitor C is 6V. Refer to a time t0' where a sample operation is performed. The sample control signal SAMPLE is enabled at a high level to turn on the sample unit 211. Via the turn-on sample unit 211, the first terminal CT of the capacitive element 220 is biased at substantially the same level as the current pixel voltage Vpix(11). This means that the pixel voltage Vpix(11) of 0V is sampled as a sample voltage Vsample(11) and stored in the capacitive element 220, i.e., Vsample(11)=0V at time t0'.

After that, refer to a time t1'. The enable signal CE is transited from a first level to a second level, e.g., from 0V to 8V. The transition of the enable signal CE at time t1' pushes up the sample voltage Vsample(11) to about 8V (=0V+8V) via the capacitive element 220. Also, at time t1', the shunt control signal SHUNT is transited from a first shunt voltage to a second shunt voltage, e.g., from 0V to 8V.

Then, refer to a time t2'. The refresh control signal REFRESH is enabled to turn on the second refresh unit 213. The data signal SOURCE has a data voltage LV1 of, for example, 6V. Between the sample voltage Vsample(11) and the pixel voltage Vpix(11), there is a voltage difference of 8V (Vsample−Vpix=8V−0V) higher than the threshold voltage of 1V of the first refresh unit 212, so that the first refresh unit 212 is turned on. Via the turn-on second and second refresh unites 212 and 213, the data voltage LV1 (=6V) of the data signal SOURCE is provided to refresh the pixel voltage Vpix (11), i.e., Vpix(11)=6V at time t2'. Meanwhile, the common voltage Vcom is flipped from for example 6V to 0V at time t2'. Thus, the refreshed image data at time t2' ("Vpix(11), Vcom"="6V, 0V") has an inversed polarity as the polarity of the image data at time t0' ("Vpix(11), Vcom"="0V, 6V").

After that, refer to a time t3'. The enable signal CE is transited from the second level to a third level, e.g., from 8V to 4V. The transition of the enable signal CE at time t3' pushes down the sample voltage Vsample(11) to about 4V (=8V−4V) via the capacitive element 220. Also, at time t3', the shunt control signal SHUNT is transited from the shunt voltage LV1' (=8V) to a shunt voltage LV2' (=6V).

Next, refer to a time t4'. The data signal SOURCE has a data voltage LV2 of, for example, 4V at time t4'. The data voltage LV2 of 4V is used to refresh another image data of 4V stored in another image data storage capacitor in the second refresh operation. Between the pixel voltage Vpix(11) and the shunt voltage LV2' of the shunt control signal SHUNT, there is a voltage difference of 0V (Vpix(11)−LV2'=6V−6V) lower than the threshold voltage of 1V of the shunt unit 214, so that the shunt unit 214 is turned off. As regards Vsample(11)=4V at time t4', the first refresh unit 212 is turned off since the voltage difference therebetween is −2V, i.e., Vsample(11)−Vpix(11)=4V−6V at time t4', lower than its threshold voltage of 1V. In view of this, the data voltage LV2 (=4V) of the data signal SOURCE will not refresh the pixel voltage Vpix(11) of 6V at time t4', neither the data voltage LV3 (=2V) at time t6' and the data voltage LV4 (=0V) of the data signal SOURCE at time t8'.

The image data of "10" is refreshed while its polarity inversed, e.g., "Vpix(10), Vcom"="0V, 4V" to "4V, 0V".

Similar operation can be referred to previous description for the image data of 6V, and is abbreviated for the sake of brevity. First, it is assumed that the pixel voltage Vpix(10) is initially 2V and the common voltage Vcom is initially 6V, indicating that the image data stored in the image data storage capacitor C is 4V.

From time t0' to time t3', the operation of the pixel voltage Vpix(10) is similar to that for the pixel voltage Vpix(11), and is omitted for the sake of brevity.

Refer to the time t4'. Between the pixel voltage Vpix(10) and the shunt voltage LV2' of the shunt control signal SHUNT, there is a voltage difference of −2V (Vpix(10)−LV2'=4V−6V) lower than the threshold voltage of 1V of the shunt unit 214, so that the shunt unit 214 is turned off. As regards Vsample(10)=6V at time t4', the first refresh unit 212 is turned on since the voltage difference therebetween is 2V (Vsample−Vpix(10)=6V−4V), higher than its threshold voltage of 1V. Also, at the time t4', the refresh control signal REFRESH is enabled again to turn on the second refresh unit 213. Via the turn-on second and second refresh unites 212 and 213, the data voltage LV2 (=4V) of the data signal SOURCE is provided to refresh the pixel voltage Vpix(10), thus pushing down the pixel voltage Vpix(10) from 6V to 4V, which is desired. Thus, the refreshed image data at time t4' ("Vpix(10), Vcom"="4V, 0V") has an inversed polarity as the polarity of the image data at time t0' ("Vpix(10), Vcom"="0V, 4V")

After that, refer to a time t5'. The enable signal CE is transited from the second level to a third level, e.g., from 4V to 0V. The transition of the enable signal CE at time t5' pushes down the sample voltage Vsample(10) to about 2V (=6V−2V)

via the capacitive element 220. Also, at time t5', the shunt control signal SHUNT is transited from the shunt voltage LV2' (=8V) to a shunt voltage LV3' (=6V).

Next, refer to a time t6'. The data signal SOURCE has a data voltage LV3 of, for example, 2V at time t6'. The data voltage LV3 of 2V is used to refresh another image data of 2V stored in another image data storage capacitor in the second refresh operation. Between the pixel voltage Vpix(10) and the shunt voltage LV3' of the shunt control signal SHUNT, there is a voltage difference of 0V (Vpix(10)−LV3'=4V−4V) lower than the threshold voltage of 1V of the shunt unit 214, so that the shunt unit 214 is turned off. As regards Vsample(10)=4V at time t6', the first refresh unit 212 is turned off since the voltage difference therebetween is −2V, i.e., Vsample(10)−Vpix(10)=2V−4V at time t6', lower than its threshold voltage of 1V. In view of this, the data voltage LV3 (=2V) of the data signal SOURCE will not refresh the pixel voltage Vpix(10) of 4V at time t6', neither the data voltage LV4 (=0V) of the data signal SOURCE at time t8'.

As to the image data of "01" ("Vpix(01), Vcom"="0V, 2V" to "2V, 0V") and "00" ("Vpix(00), Vcom"="0V, 0V" to "0V, 0V"), their operation, thus, can be described similarly with reference to the above-related description of the refresh operations for the image data storage capacitor C of "11" and "10", and will not be specified for the sake of brevity.

Figure 6A:
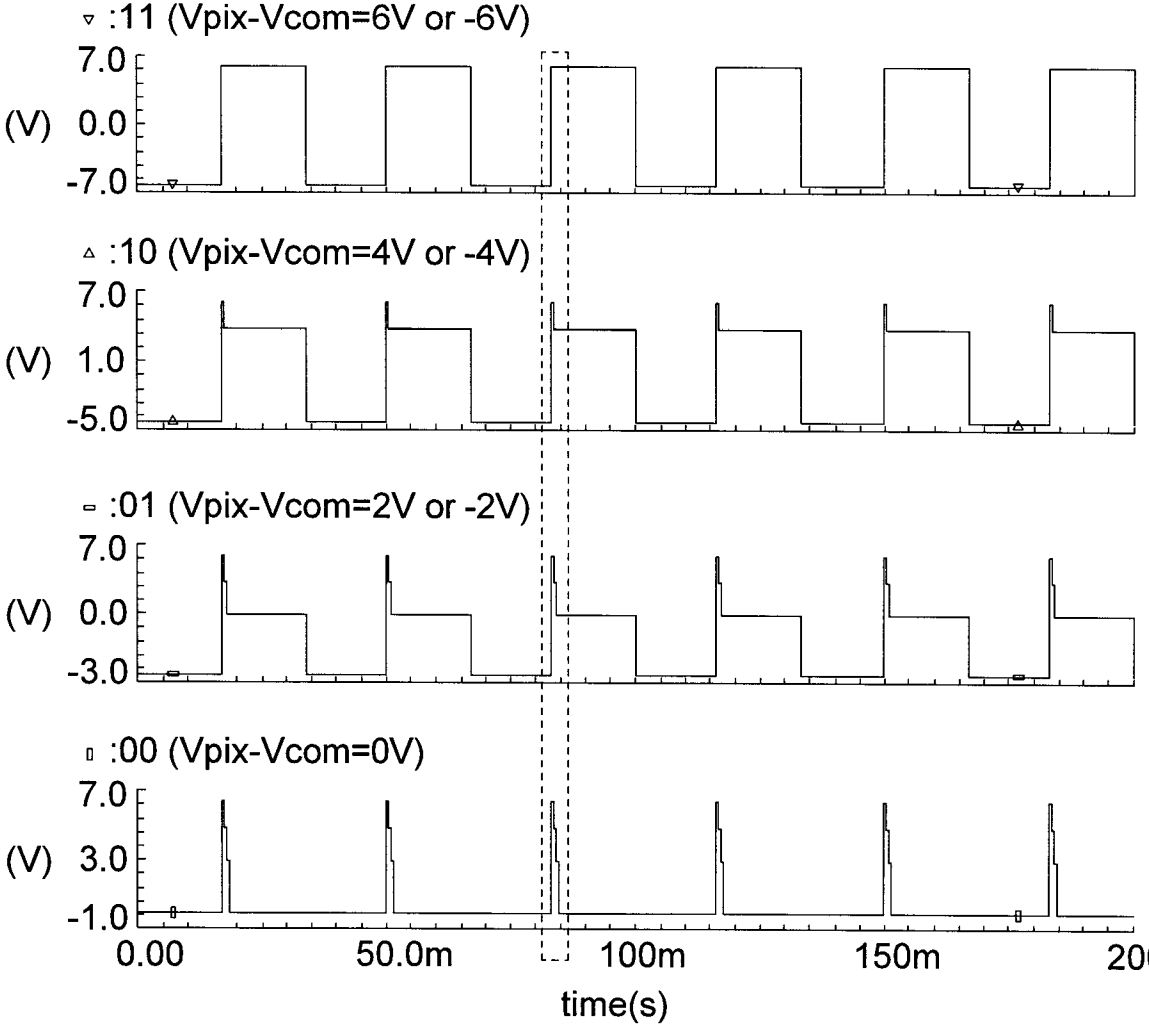
FIG. 6A a timing diagram showing a number of simulated waveforms when four kinds of image data are refreshed according to the signal waveforms in FIG. 5B.
Figure 6B:
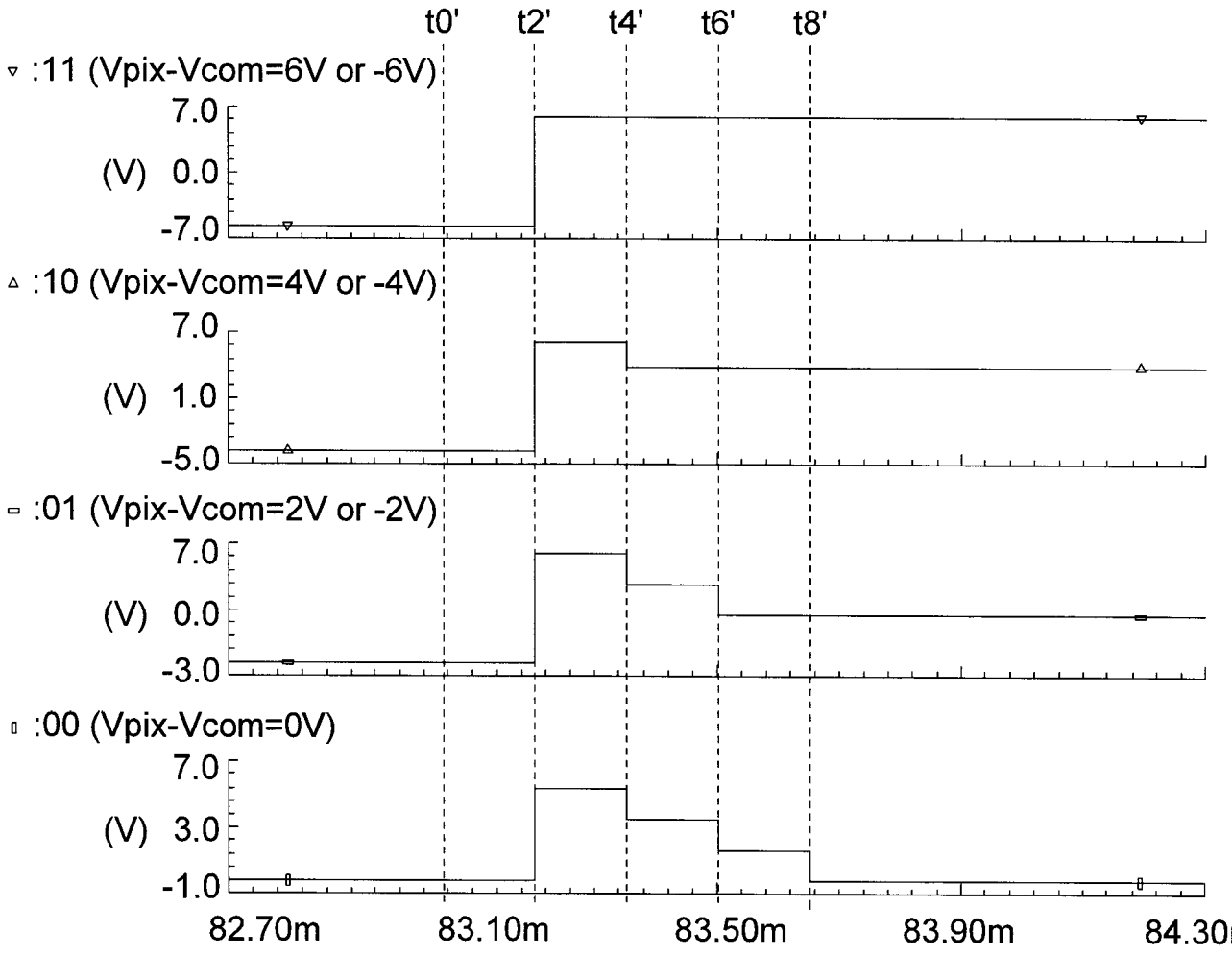
FIG. 6B is a timing diagram showing a number of simulated waveforms taken from a region in FIG. 6A denoted by dashed line.

FIG. 6A a timing diagram showing a number of simulated waveforms when four kinds of image data are refreshed according to the signal waveforms in FIG. 5B. FIG. 6B is a timing diagram showing a number of simulated waveforms taken from a region in FIG. 6A denoted by dashed line. As is shown in FIGS. 6A and 6B, for an image data of "11" (Vpix−Vcom=6V) in the image data storage capacitor, it can be refreshed as selectively having the same polarity or the inversed polarity, i.e., 6V or −6V. The image data of "10", "01" and "00" can be refreshed in a similar manner.

There are several circuit variations of the MIP circuit according to the embodiment of the current invention in FIG. 5A. Among them, another two embodiments of the pixel element are provided in FIG. 7 and FIG. 8 for illustration.

Figure 7:
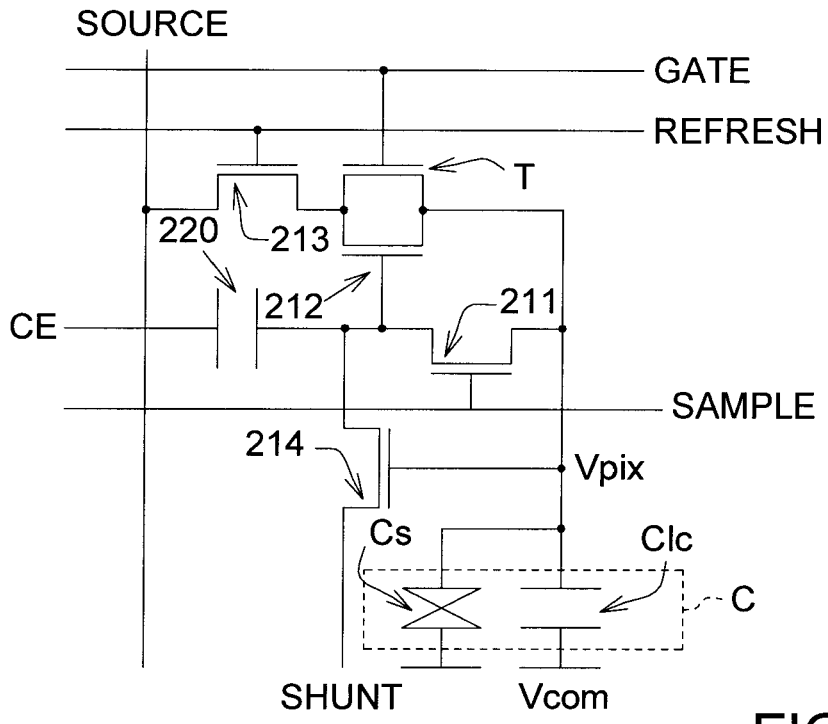
FIG. 7 is a circuit diagram showing an example of the pixel element in FIG. 1 according to another embodiment of the invention.

FIG. 7 is a circuit diagram showing an example of the pixel element in FIG. 1 according to another embodiment of the invention. The embodiment in FIG. 7 differs with the embodiment in FIG. 5A in that the gate switch T has two data terminals electrically connected with two data terminals of the first refresh unit 212.

Figure 8:
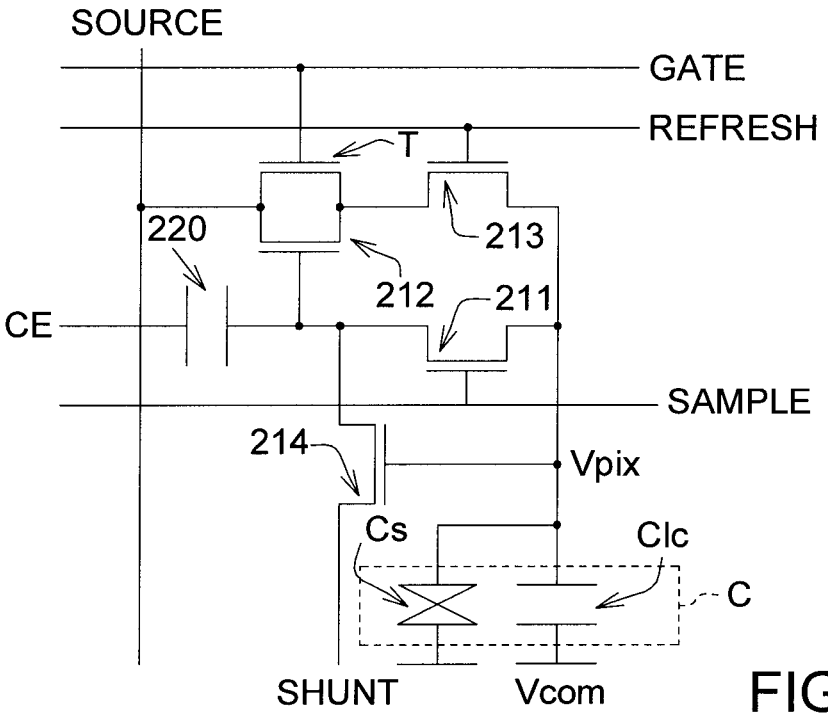
FIG. 8 is a circuit diagram showing an example of the pixel element in FIG. 1 according to another embodiment of the invention.

FIG. 8 a circuit diagram showing an example of the pixel element in FIG. 1 according to another embodiment of the invention. The embodiment in FIG. 8 differs with the embodiment in FIG. 7 in that the second refresh unit 213 is coupled between the first refresh unit 212 and the image data storage capacitor C.

Employing the proper control signals, such as the sample control signal SAMPLE, gate control signal GATE, refresh control signal REFRESH, data signal SOURCE, enabled signal CE, and shunt control signal SHUNT as shown in FIG. 5B, to the switches 212-214 and the gate switch T, the MIP circuits in FIGS. 7-8 have the similar performance as that in FIG. 5A. As for the MIP circuits in FIGS. 7-8, their operation, thus, can be described similarly with reference to the above-related description of the circuit in FIG. 5A and will not be specified for the sake of brevity.

According to the active matrix pixel array, the pixel element and the operating method thereof disclosed in the embodiment of the invention, a switch is provided to control the stored data of a capacitive element which is implemented as a memory for storing image data of the image data storage capacitor. This pixel element can be served as a multi-bit memory, so that the image data storage capacitor can be used to store different image data and refreshed by one of the voltages of the data signal. Therefore, a multi-bit pixel element can be achieved with high resolution and an increased number of gray-levels.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display panel, comprising:

an active matrix pixel array comprising:

a plurality of gate lines;

a plurality of source lines; and a plurality of pixel elements arranged in a matrix, each pixel element being coupled to the corresponding gate line and the corresponding source line, each pixel element comprising:

an image data storage capacitor for storing an image data;

a sample unit having a control terminal for receiving a sample control signal;

a capacitive element having a first terminal coupled to a pixel electrode of the image data storage capacitor via the sample unit;

a first refresh unit having a control terminal coupled to the first terminal of the capacitive element;

a second refresh unit having a control terminal for receiving a refresh control signal, the first and second refresh units being serially coupled with each other and between the corresponding source line and the image data storage capacitor for receiving a data signal; and a shunt unit having a control terminal coupled to the pixel electrode of the image data storage capacitor, a data terminal coupled to the first terminal of the capacitive element, and another data terminal for receiving a shunt control signal, wherein each of the shunt control signal and the data signal sequentially has a plurality of voltages during a plurality of period, and the voltages are in a monotonic order, wherein each of the data signal and the shunt control signal sequentially has a first voltage during a first period, a second voltage during a second period, a third voltage during a third period, and a fourth voltage during a fourth period, these units include N-type transistors, the first voltage is higher than the second voltage, and wherein the transition from the first voltage to the second voltage in the shunt control signal is in advance of the transition from the first voltage to the second voltage in the data signal;

a source driver for driving the source lines; and a gate driver for driving the gate lines.

2. The display panel according to claim 1, wherein each of the shunt control signal and the data signal is transited from one voltage to another when the refresh control signal is disabled.

3. The display panel according to claim 1, wherein the capacitive element further has another terminal for receiving an enable signal.

4. The display panel according to claim 3, wherein the enable signal is transited from a first level to a second level, and a difference between the first level and the second level is higher than the threshold voltage of the first refresh unit.

5. The display panel according to claim 1, wherein each pixel element further comprises:

a gate switch having a control terminal coupled to the corresponding gate line, the gate switch being coupled between the corresponding source line and the image data storage capacitor.

6. The display panel according to claim 1, wherein the first refresh unit is coupled between the second refresh unit and the image data storage capacitor.

7. The display panel according to claim 1, wherein the second refresh unit is coupled between the first refresh unit and the image data storage capacitor, and the first refresh unit is coupled between the second refresh unit and the source line.

8. An operating method for a display panel, comprising:

storing an image data in an image data storage capacitor; storing the image data of the image data storage capacitor in a capacitive element through a sample unit; in a first period, providing a shunt control signal having a first shunt voltage to selectively control the voltage of a first terminal of the capacitive element through a shunt unit, and providing a data signal having a first data voltage to selectively refresh the image data of the image data storage capacitor through a first refresh unit and a second refresh unit, the first refresh unit being controlled by the voltage of the first terminal of the capacitive element, the shunt unit being controlled by the voltage of the pixel electrode of the image data storage capacitor; and in a second period, providing the shunt control signal having a second shunt voltage to selectively control the voltage of the first terminal of the capacitive element through the shunt unit, and providing the data signal having a second data voltage to selectively refresh the image data of the image data storage capacitor through the first and second refresh units, wherein the transition from the first shunt voltage to the second shunt voltage in the shunt control signal is in advance of the transition from the first data voltage to the second data voltage in the data signal, and wherein when the image data is of a first image data, the image data of the image data storage capacitor are refreshed during the first period, and when the image data is of a second image data, the image data of the image data storage capacitor are refreshed during the second period.

9. The method according to claim 8, wherein the refreshed image data in the image data storage capacitor selectively has the same polarity or the inversed polarity as the polarity of the image data stored in the image data storage capacitor in the step of storing the image data of the image data storage capacitor in the capacitive element through the sample unit.

10. The method according to claim 8, wherein these units include N-type transistors, the first shunt voltage is larger than the second shunt voltage, the first data voltage is larger than the second data voltage.

11. The method according to claim 8, wherein the transition from the first shunt voltage to the second shunt voltage in the shunt control signal, and the transition from the first data voltage to the second data voltage in the data signal both occur when the refresh control signal is disabled.

12. The method according to claim 8, wherein the capacitive element further has a second terminal for receiving an enable signal, the enable signal is transited from the first level to a second level in the first period, a difference between the first level and the second level of the enabled signal is higher than the threshold voltage of the first refresh unit.

13. a display panel, comprising:

a plurality of gate lines and a plurality of source lines; and a plurality of pixel elements arranged in a matrix, each pixel element being coupled to the corresponding gate line and the corresponding source line, each pixel element comprising: an image data storage capacitor for storing an image data; a sample unit controlled by a sample control signal; a capacitive element having a first terminal coupled to a pixel electrode of the image data storage capacitor via the sample unit; a first refresh unit controlled by the voltage on the first terminal of the capacitive element; a second refresh unit controlled by a refresh control signal, the first and second refresh units transmitting a data signal from the corresponding source line to the image data storage capacitor when both of the first and second refresh units are enabled; and a shunt unit controlled by the voltage on the pixel electrode of the image data storage capacitor, the shunt unit having a data terminal coupled to the first terminal of the capacitive element, and another data terminal for receiving a shunt control signal, wherein each of the shunt control signal and the data signal sequentially has a plurality of voltages during a plurality of period, and the voltages are in a monotonic order, wherein each of the data signal and the shunt control signal sequentially has a first voltage during a first period, a second voltage during a second period, a third voltage during a third period, and a fourth voltage during a fourth period, these units include N-type transistors, the first voltage is higher than the second voltage, and wherein the transition from the first voltage to the second voltage in the shunt control signal is in advance of the transition from the first voltage to the second voltage in the data signal.

* * * * *